United States Patent [19]

Whitlock

[11] 4,276,807

[45] Jul. 7, 1981

[54] RIFLE BATON

[76] Inventor: Ben H. Whitlock, 137 Cedarhurst St., Islip Terrace, N.Y. 11752

[21] Appl. No.: 65,721

[22] Filed: Aug. 10, 1979

[51] Int. Cl.[3] ..... F41C 23/00

[52] U.S. Cl. ..... 89/37 BA; 42/1 ST; 42/71 R; 42/72

[58] Field of Search ..... 42/94, 71 R, 71 P, 72; 73/167; 89/37 BA

[56] References Cited

U.S. PATENT DOCUMENTS 223,926 1/1880 Kinney ..... 42/72

FOREIGN PATENT DOCUMENTS 388457 of 0000 Fed. Rep. of Germany ..... 42/72

*Primary Examiner*—Stephen C. Bentley

*Attorney, Agent, or Firm*—Leonard W. Suroff

[57] ABSTRACT

A support assembly for a hand gun having a rifle-like unit. Sighting means is provided for use in assembled relation with the support assembly, and mounting means is utilized for removably securing the sighting means relative to the upper end so as to obtain adjustment thereof. Coupling means is associated with the support assembly and is adapted for receiving a hand gun in removably coupled relation thereto adjacent to the front end. Holding means is provided for maintaining the barrel of the hand gun in fixed position during use thereof, and the holding means includes a vertically extending channel having a resilient arm associated therewith for maintaining the barrel in removably positioned confinement within the channel.

20 Claims, 9 Drawing Figures

RIFLE BATON

BACKGROUND OF THE INVENTION

1. Field of the Invention

The present invention relates to a support assembly to which a hand gun or pistol may be secured such that the combined support assembly and hand gun may be utilized to obtain improved firing accuracy of the hand gun.

2. Description of the Prior Art

It has been appreciated in the prior art that the ability to mount a hand gun such that it essentially forms part of a rifle-like assembly would provide for a stabilizing factor to permit the user to improve the aim and in turn the accuracy of the hand gun, as compared to its utilization by itself. There are many instances in which it is desirable to be able to improve the firing accuracy of a hand gun, and the present invention permits this ready and easy improvement in a manner not anticipated or provided for in the prior art.

U.S. Pat. Nos. 2,433,151; 3,609,902 and 3,861,273 exemplify the prior art appreciation that the accuracy of a hand gun may be improved by somehow coupling it to a support. The present invention provides for and appreciates the various circumstances by which the utilization of a hand gun may be enhanced if it may be readily coupled to a support assembly that has the unique features and characteristics of the present invention.

OBJECTS OF THE INVENTION

An object of the present invention is to provide a support assembly that may be readily coupled to a hand gun such that the accuracy and aiming of the hand gun may be substantially improved.

Another object of the present invention is to provide a support assembly that may be used in a rifle-like manner with the hand gun at the front end thereof and capable of having a support platform brought into position as required for use of the assembly.

Another object of the present invention is to provide a support assembly that may be easily coupled with the hand gun and having sighting means that may be laterally and vertically adjusted for increasing the accuracy of the hand gun.

Other objects and advantages of the present invention will become apparent as the disclosure proceeds.

SUMMARY OF THE INVENTION

A support assembly for a hand gun is disclosed comprising in combination a rifle-like unit having a front end and spaced body-engaging read end, with an upper end and lower end intermediate the front and rear ends. Sighting means is provided for use with the support assembly and in conjunction with the hand gun or pistol. Mounting means for removably securing the sighting means relative to the upper end so as to obtain adjustment thereof as desired is provided.

Coupling means is associated with the upper end and is adapted for receiving a hand gun in removably coupling relation thereto adjacent to the front end when in assembled position with the support assembly. The coupling means includes a seat formed on the upper end and adapted to receive the butt of the hand gun to be contained therein. The seat has a bottom wall adapted to have the free end of the butt rest thereon when the hand gun is positioned in firing position on the rifle-like unit. A first wall and a second wall extending upwardly from the bottom wall in spaced relationship to each other is provided such that the butt of the hand gun is contained within the seat in the assembled position therewith.

Engaging means is associated with either the first or second wall for yieldably urging the butt into contact with the opposite one of the walls such that removable retainment of the butt within the seat is obtained. Holding means is mounted intermediate the coupling means and the front end for maintaining the barrel of the hand gun in fixed position during use thereof. The holding means includes a vertically extending channel having a resilient arm associated therewith for maintaining the barrel in removably positioned confinement within the channel.

The support assembly includes lateral adjustment means operatively associated with the sighting means in the form of a housing having a cavity therein with supports on each end thereof, as well as a body portion extending from the telescopic means with a transversely threaded aperture extending therethrough and positioned within the cavity. A threaded shaft rotatably mounted between the supports and extending through the threaded aperture is provided such that rotation of the shaft will obtain lateral movement of the sighting means, and a knob is connected to one end of the threaded shaft to facilitate rotation thereof.

The support assembly further includes vertical adjustment means operatively associated with the sighting means and has a housing having a cavity therein with supports on each end thereof. The body portion extends from the telescopic means with a tooth rack coupled to the body portion. A gear element is rotatably mounted between the supports and meshing with the tooth rack such that rotation of the gear element will obtain vertical movement of the sighting means, and a handle is connected to one end of the gear element to facilitate rotation thereof. Stationary means is interposed between the handle and the housing to maintain the gear element in proper position during use thereof.

The support assembly also includes platform means pivotally coupled at one end thereof to the rifle-like unit and movable between a stored position and an operational position so as to obtain elevational adjustment for the support assembly at different levels in the operational position. The platform means includes first and second tubular elongated members each having a free end and extending in telescopic relationship to each other, with resilient means extending between the first and second tubular members and adapted to be depressed so as to permit the members to be adjusted between a retracted and an extended position. Linking means for pivotally mounting the first member relative to the rifle-like unit at one end remote from the free end thereof is provided. First locking means is utilized for retaining the tubular members in the stored position when desired, and a second locking means is provided for retaining the tubular members in the operative position when desired.

The resilient means includes an aperture in the second elongated member, and a latch member resiliently mounted in the second member and adapted to extend through the aperture when the second member is extended such that the aperture extends below the free end of the first member and is in its extended position. The platform means may also include a third member having a free end and telescopically extending in the second member and longitudinally adjustable with respect thereto.

The platform may also include an aperture extending through the third member, and a locking element resiliently mounted in the third member and adapted to extend through the aperture when the third member is extended such that the aperture extends below the free end of the second member and is in its extended position. The locking element may have a beveled edge for engagement with the free end of the first and second members when collapse of the platform means is desired from its extended to its retracted position.

The first locking means may include a plate on the free end of the third member which has a depression therein, and a spring-mounted catch extends from the rifle-like unit, and is adapted to be received in the depression when the platform means is in its stored position. The second locking element includes a bracket on the first member on the end remote from the free end and having a socket therein, and a ball element extends from the rifle-like unit, and is adapted to be received in the socket when the platform is in its operative position.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
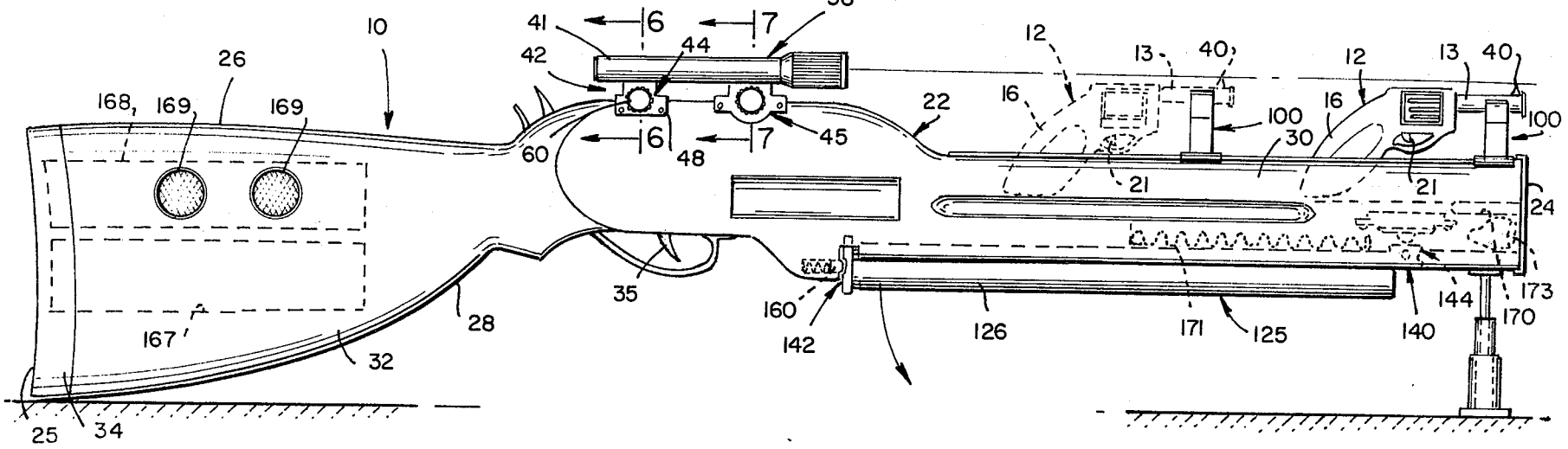
FIG. 1 is a side view of the present invention with the hand gun in assembled relationship therewith.
Figure 2:
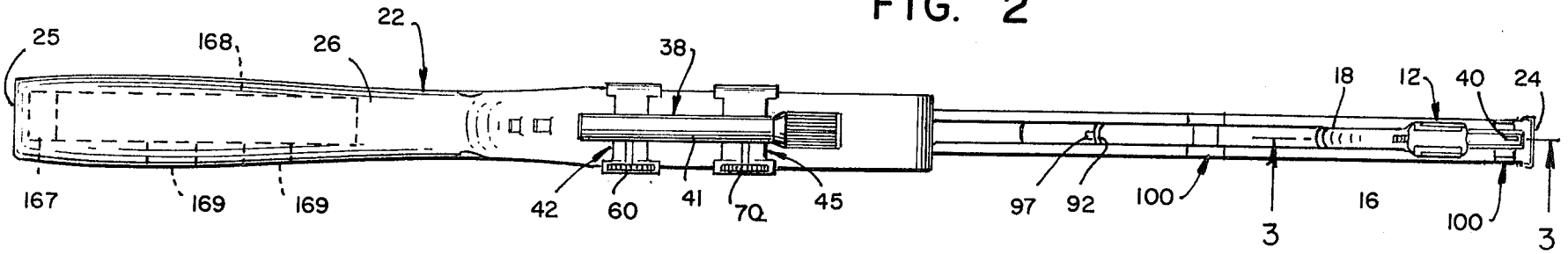
FIG. 2 is a top plan view of the support assembly illustrated in FIG. 1.

Referring to the drawings there is illustrated in FIG. 1–9 a support assembly 10 that is adapted to be used with a hand gun or pistol 12 so as to provide a combination that enhances the accuracy of the pistol 12. The pistol 12 may be of a conventional type having a barrel 13 with a butt or handle 14 terminating in a free end 15 and spaced apart sides 16 with an inner contoured edge 18 and outer contoured edge 20 spaced intermediate the sides 16 and 18. The hand gun 12 has a trigger 21 which will still be used for firing of the hand gun 12.

The support assembly 10 includes a rifle-like unit 22 that is fabricated from a plastic, metallic or wood material and contoured to various selected configurations. The unit includes a front end 24 and spaced apart body-engaging rear end 25 with an upper end 26 and lower end 28 intermediate the front and rear ends 24 and 25 respectively. The unit 22 may include an elongated barrel portion 30, a stock portion 32 and butt portion 34, as in a conventional rifle. Furthermore at least one trigger element 35 may be provided for the purpose hereinafter disclosed.

Sighting means 38 may be utilized for use in conjunction with the hand gun 12 and the normal sight element 40 thereof. The sighting means 38 may be of a telescopic type having an outer casing or shell 41 containing a lense therein. Since the hand gun 12 may vary in size and shape the sight element 40 may vary in position from hand gun to hand gun. To overcome this problem there is provided mounting means 42 for removably securing the sighting means 38 relative to the upper end 26 of the unit 22 and to obtain adjustment thereof as required. The mounting means 42 may include lateral adjustment means 44 and vertical adjustment means 45, as illustrated in FIGS. 6 and 7 particularly.

The sighting means 38 has associated with it cross-hairs 46 which is to be aligned with the sighting element 40 to provide for the enhanced accuracy of the pistol 12. To accomplish this the sighting means 38 may require lateral or vertical adjustment when the pistol 12 is initially assembled with the unit 22. The lateral adjustment means 44 is operatively associated with the sighting means 38 and includes a housing 48 having a cavity 50 therein with supports 52 on each end thereof. A body portion 54 extends from the sighting means 38 with a transversely threaded aperture 55 extending therethrough and positioned within the cavity 50.

Figure 6:
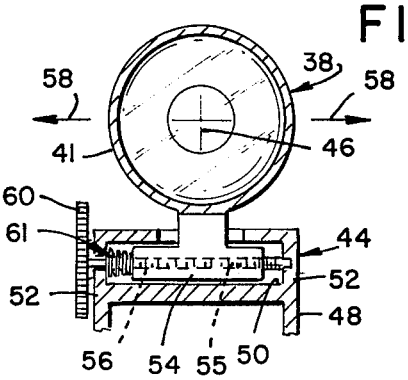
FIG. 6 is an enlarged sectional view taken along lines 6—6 of FIG. 1.
Figure 7:
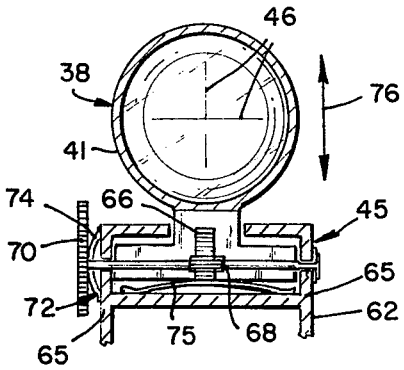
FIG. 7 is an enlarged sectional view taken along lines 7—7 of FIG. 1.

A threaded shaft 56 is rotatably mounted between the supports 52 and extends in the threaded aperture 55 such that rotation of the shaft 56 will obtain lateral movements of the sighting means 38 in the direction of either arrow 58 as illustrated in FIG. 6. A knob 60 is connected to one end of the shaft 56 to facilitate rotation thereof.

Accordingly the lateral adjustment means 44 provides for the necessary movement of the sighting means 38 in a simple and efficient manner for the desired alignment of the cross-hairs 46 with the sight element 40. The lateral adjustment means 44 may further include spring means 61 interposed between the body portion 54 and one of the supports 52 for urging the body portion into desired positionment on the shaft 56.

The support assembly 10 further includes the vertical adjustment means 45 operatively associated with the sighting means 38 and has a housing 62 as illustrated in FIG. 7, having a cavity 50 therein with supports 65 on each end thereof. The body portion 54 extends from the telescopic means 38 with a tooth rack 66 coupled to the body portion 54. A gear element 68 is rotatably mounted between the supports 65 and meshing with the tooth rack 66 such that rotation of the gear element 68 will obtain vertical movement of the sighting means 38. A handle 70 is connected to one end of the gear element to facilitate rotation thereof. Stationary means 72 is interposed between the handle 70 and the housing 65 to maintain the gear element 68 in proper position during use thereof. The stationary means may be in the form of a spring 74, and in addition a spring 75 may be in the cavity 50 to provide an upward force against the body portion 54.

The above described relationship of the lateral adjustment means 44 and vertical adjustment means 45 permits the adjustment of the sighting means 38 in the direction of arrows 58 and 76, respectively.

Coupling means 80 is associated with the upper end 26 and is adapted for receiving the hand gun 12 in removably coupling relationship thereto adjacent to the front end 24 when in assembled position with the support assembly 10. The coupling means 80 includes a seat 82 formed on the upper end 26 and adapted to receive the butt 14 of the hand gun 12 to be contained therein. The seat 82 has a bottom wall 84 adapted to have the free end 15 of the butt 14 rest thereon when the hand gun 12 is positioned in firing position on the rifle-like unit 22. A first wall 85 and second wall 86 extend upwardly from the bottom wall 84 in spaced relationship to each other such that the butt 14 of the hand gun 12 is contained within the seat 82 in the assembled position, therewith.

Figure 5:
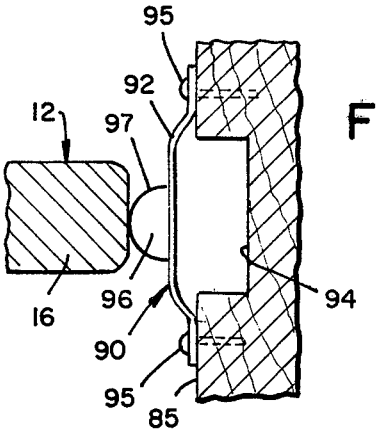
FIG. 5 is a fragmentary view taken along lines 5—5 of FIG. 3.

Engaging means 90 is associated with either the first or second wall 85 or 86 for yieldably urging the butt 16 into contact with the opposite one of the walls such that removable retainment of the butt 16 within the seat 82 is obtained. As illustrated in FIG. 5 the engaging means 90 includes a plate 92 extending across a depression 94 on wall 85 and secured at each end as by pin 95 to the unit 22. The plate 92 may be flexible and have a projection 96 extending therefrom. The projection may include a contoured leading edge 97 to facilitate easy insertion and removability of the butt 14 within the seat 82.

Figure 3:
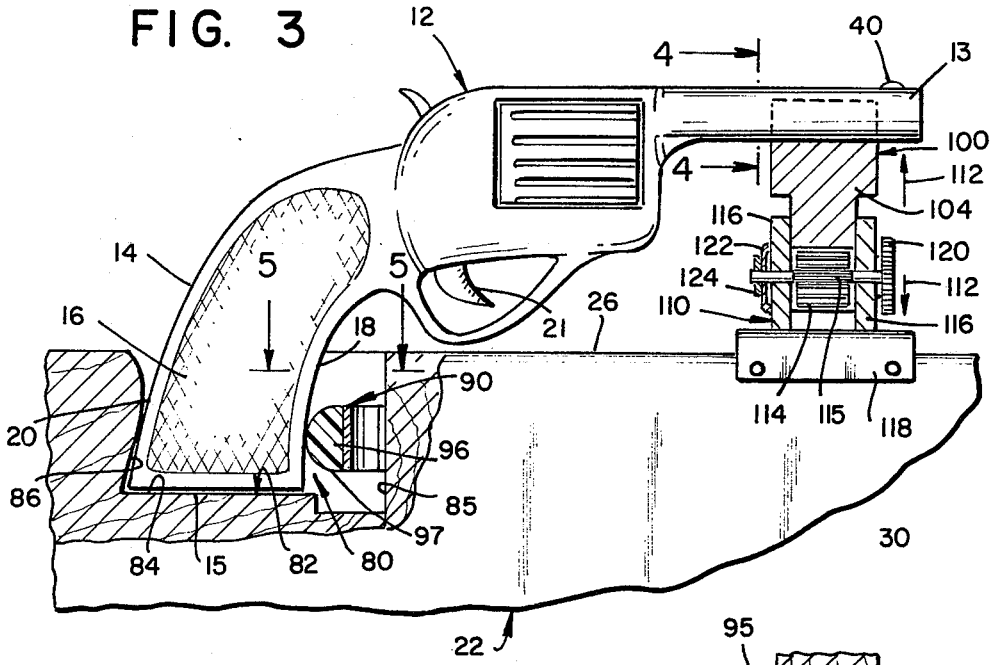
FIG. 3 is an enlarged fragmentary view taken along lines 3—3 of FIG. 2.

In this manner when use of the support assembly 10 is desired the user may commence operation by inserting the butt 14 of the hand gun 12 within the seat 82 and by pivoting same bring the hand gun 12 into the position illustrated in FIG. 3 with the outer contoured edge 20 engaging the first wall 85 and the inner contoured edge 18 engaging the leading edge 97 of projection 96.

Figure 4:
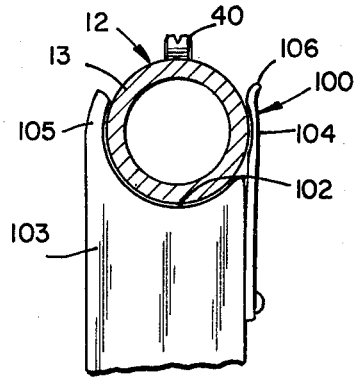
FIG. 4 is a fragmentary view taken along lines 4—4 of FIG. 3.

Holding means 100 is mounted intermediate the coupling means 80 and the front end 24 for maintaining the barrel 13 of the hand gun 12 in fixed position during use thereof. The holding means 100 includes a vertically extending channel 102 having a resilient arm 104 associated therewith for maintaining the barrel 13 in removably positioned confinement within the channel 102. The channel 102 is formed in a holder 103, as illustrated in FIG. 4, in which the resilient arm 104 is spaced from a fixed arm 105 that may coupled to or integrally formed with the holder 104. In seated relationship the barrel 13 is frictionally retained in position and the barrel 13 comes to rest in place after the butt 15 is confined within the seat 82. The resilient arm 104 may have an outward flare at its free end 106 so as to facilitate the easy insertion of the barrel 13 in a minimum of time.

The hand gun 12 that will be used by an individual, for example a law enforcement officer, will generally be the same, and therefore an initial adjustment of the lateral adjustment means 44 and vertical adjustment means 45 is all that is required. In addition there may be required an adjustment of the barrel 13 which is accomplished by elevational means 110 associated with the holding means 100 so as to permit vertical adjustment of the level of the barrel 13 for adjustment of the sight thereon relative to the sighting means 38 as required. The vertical adjustment is obtained in the direction of arrows 112. The elevational means 110 includes a gear rack 114 associated at one end of the holder 103 with the holding means 100, and a rotatably mounted gear 115 to mesh with the gear rack 114 for vertical adjustment of the holding means 100.

The elevational means 110 may include a pair of plates 116 extending from a bracket 118 coupled to the upper end 26. The gear element 115 is rotatably mounted between the plates 116 and a gripping element 120 is mounted thereon to facilitate rotation thereof. A tension spring element 122 may be interposed between a plate 116 and an end cap 124, to prevent lateral play in the gear element 115. There may be provided two engaging means 90 and holding means 100; the forward one for usage with the sighting means 38, the rearward one if the pistol 12 is used when the rifle-like unit 22 is held against, say, the hip of the user and the pistol 12 is fired.

Figure 8:
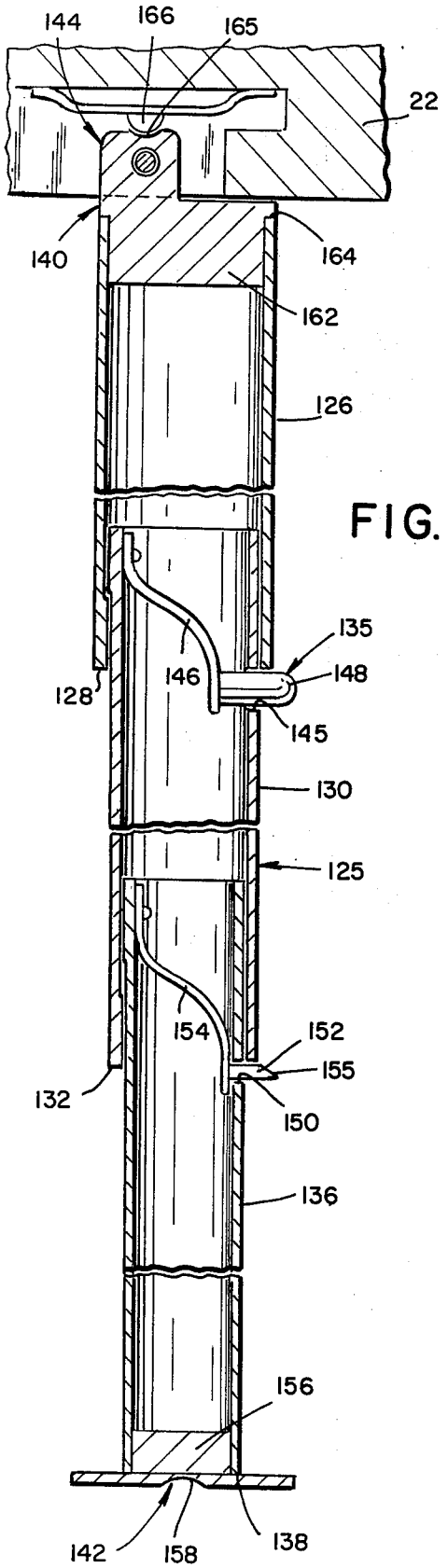
FIG. 8 is a sectional view of the platform means in its operative and fully extended position.
Figure 9:
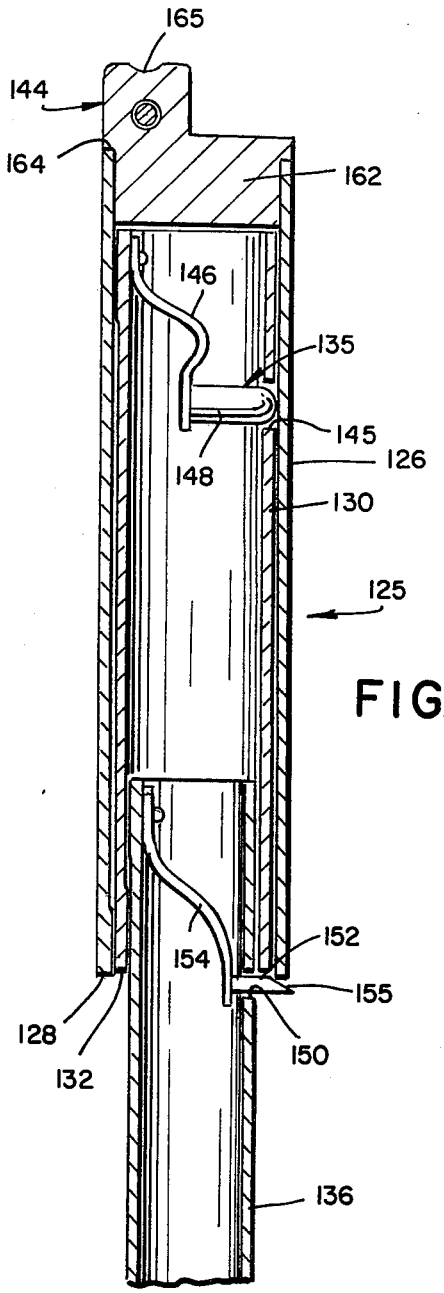
FIG. 9 is a view similar to FIG. 8 illustrating the platform means as it is being retracted.

The support assembly 10 also includes platform means 125 pivotally coupled at one end thereof to the rifle-like unit 22 and movable between a stored position and an operational position so as to obtain elevational adjustment for the support assembly at different levels in the operational position. The platform means 125, as illustrated in FIGS. 8 and 9, includes a first tubular elongated member 126 having a free end 128 and a second tubular elongated member 130 having a free end 132 and extending in telescopic relationship to each other. Resilient means 135 extends between the first member 126 and the second member 130 and adapted to be depressed so as to permit the members 126 and 130 to be adjusted between a retracted and an extended position. A third member 136 having a free end 138 extends telescopically in the second member 130 and is longitudinally adjustable with respect thereto. Linking means 140 for pivotally mounting the first member 126 relative to the rifle-like unit 22 is provided at one end remote from the free end 128 thereof.

First locking means 142 is utilized for retaining the tubular members 126 and 130 in the stored position when desired, and a second locking means 144 is provided for retaining the tubular members 126, 130 and 136 in the operative position when desired. The resilient means 135 includes an aperture 145 in the second elongated member 130, and a latch member 146 resiliently mounted in the second member 130 and adapted to extend through the aperture 145 when the second member 130 is extended such that the aperture 145 extends below the free end 128 of the first member 126 and is in its extended position. The latch member 146 may include an extension 148 which extends through the aperture 145.

The platform means 125 may also include an aperture 150 extending through the third member 136, and a locking element 152 resiliently mounted in the third member 136 by a clip 154 and adapted to extend through the aperture 150 when the third member 136 is extended such that the aperture 150 extends below the free end 132 of the second member 130 and is in its extended position. The locking element 152 may have a beveled edge 155 for engagement with the free ends 128 and 132 of the first member 126 and second member 130 respectively, when collapse of the platform means 125 is desired from its extended to its retracted position. The retracted position is illustrated in FIG. 1 and the extended positon in FIGS. 8 and 9.

The first locking means 142 may include a plate 156 on the free end 138 of the third member 136 which has a depression 158 therein. A spring-mounted catch 160, as illustrated in FIG. 1, extends from the rifle-like unit 22, and is adapted to be received in the depression 158 when the platform means 125 is in its stored position. The second locking means or element 144 includes a bracket 162 on the first member 126 on the end 164 remote from the free end 128 and having a socket 165 therein. A resiliently mounted ball element 166 extends from the rifle-like unit 22, and is adapted to be received in the socket 165 when the platform means 125 is in its operative position.

The platform means 125 permits the user of the support assembly 10 to obtain desired elevational height adjustments when positioning the support assembly 10 for use thereof. The present invention also provides a storage chamber 168 to store a throw line such as in use to climb a burning building or as a whiplash to disarm a person. The throw line may be used in a water rescue or other procedure as well.

The support assembly 10 includes the storage chamber 167 in the stock portion 32 thereof so as to permit additional supplies to be retained therein, such as a two-way radio 168 having a pair of openings 169, to act as a speaker and transmitter opening with the radio 168. In addition, the support assembly 10 may include at least one barrel chamber 170 extending rearwardly from the free end 24 of the unit 22 and adapted to contain an item, such as a rope 171 projectable by engaging the trigger 35, at least one of which is provided. The manner of projecting the rope 171 may be by a conventional manner.

In the alternative, the chamber 170 may be used for storage and the rope 171 manually removed therefrom. The rope 171 may have a weight 173 attached thereto. The weight 173 may be connected to a grappling hook (not shown) externally of the barrel portion 30.

A small non-adjustable stationary support 172 may be provided on the barrel portion 30 for immediate support as required. In this manner the user of the device can quickly and conveniently assemble the hand gun 12 with the assembly 10 for use thereof and obtain the desired accuracy superior to use of the hand gun 12 alone. The hand gun 12 can be removed in a short period of time as desired and the hand gun 12 replaced in the holster of the user or stored away.

In addition, the assembly 10 is compact when not in use and may be stored in a patrol car, or used by a person not wishing to purchase a rifle in addition to a hand gun. It is appreciated that the weight of the assembly 10 is lighter than a rifle, yet the hand gun may quickly be assembled and made operational when required.

Although an illustrative embodiment of the invention has been decribed in detail herein with reference to the accompanying drawings, it is to be understood that the invention is not limited to the precise embodiment and that various changes and modifications may be effected therein without departing from the scope or spirit of the invention.

I claim:

1. A support assembly for hand gun comprising in combination:

A. a rifle-like unit having a front end and spaced body-engaging rear end, with an upper end and lower end intermediate said front and rear ends, B. sighting means for use with the support assembly, C. mounting means for removably securing said sighting means relative to said upper end so as to obtain adjustment thereof as desired, D. coupling means associated with said upper end and adapted for receiving a hand gun in removably coupled relation thereto adjacent to said front end when in assembled position with the support assembly, E. said coupling means includes:

(1) a seat formed on said upper end adapted to receive the butt of the hand gun to be contained therein, (2) said seat having a bottom wall adapted to have the free end of the butt rest thereon when the hand gun is positioned, (3) a first wall and a second wall extending upwardly from said bottom wall in spaced apart relationship to each other such that the butt of the hand gun is contained within said seat, (4) engaging means associated with either said first or second wall for yieldably urging the butt into contact with the opposite one of said walls such that removable retainment of the butt within said seat is obtained, F. holding means mounted intermediate said coupling means and said front end for maintaining the barrel of the hand gun in fixed position during use thereof, and G. said holding means including a vertically extending channel having a resilient arm associated therewith for maintaining the barrel in removably positioned confinement within said channel.

2. A support assembly as in claim 1, including lateral adjustment means operatively associated with said sighting means.

3. A support assembly as in claim 2, said lateral adjustment means including:

a. a housing having a cavity therein with supports on each end thereof.

b. a body portion extending from said telescopic means with a transversely threaded aperture extending therethrough and positioned within said cavity, c. a threaded shaft rotatably mounted between said supports and extending through said threaded aperture such that rotation of said shaft will obtain lateral movement of said sighting means, and d. a knob connected to one end of said threaded shaft to facilitate rotation thereof.

4. A support assembly as in claim 3, said lateral adjustment means including spring means interposed between said body portion and one of said supports for urging said body portion into desired positionment on said shaft.

5. A support assembly as in claim 1, including vertical adjustment means operatively associated with said sighting means.

6. A support assembly as in claim 5, said vertical adjustment means including:

a. a housing having a cavity therein with supports on each end thereof, b. a body portion extending from said telescopic means, c. a tooth rack coupled to said body portion, d. a gear element rotatably mounted between said supports and meshing with said tooth rack such that rotation of said gear element will obtain vertical movement of said sighting means, and e. a handle connected to one end of said gear element to facilitate rotation thereof.

7. A support assembly as in claim 6, stationary means interposed between said handle and said housing to maintain said gear element in proper position during use thereof.

8. A support assembly as in claim 1, including platform means pivotally coupled at one end thereof to said rifle-like unit and movable between a stored position and an operational position so as to obtain elevational adjustment for the support assembly at different levels in the operational position.

9. A support assembly as in claim 8, said platform means including:

a. a first and second tubular elongated members each having a free end and extending in telescopic relationship to each other, b. resilient means extending between said first and second tubular members and adapted to be depressed so as to permit said members to be adjusted between a retracted and an extended position, c. linking means for pivotally mounting said first member relative to said rifle-like unit at one end remote from said free end thereof, d. first locking means for retaining said tubular members in said stored position when desired, and e. second locking means for retaining said tubular members in said operative position when desired.

10. A support assembly as in claim 9, wherein said resilient means includes:

a. an aperture in said second elongated member, and b. a latch member resiliently mounted in said second member and adapted to extend through said aperture when said second member is extended such that said aperture extends below said free end of said first member and is in its extended position.

11. A support assembly as in claim 9, including a third member having a free end and telescopically extending in said second member and longitudinally adjustable with respect thereto.

12. A support assembly as in claim 11, including:

a. an aperture extending through said third member, and b. a locking element resiliently mounted in said third member and adapted to extend through said aperture when said third member is extended such that said aperture extends below said free end of said second member and is in its extended position.

13. A support assembly as in claim 12, said locking element having a beveled edge for engagement with said free end of said first and second members when collapse of said platform means is desired.

14. A support assembly as in claim 12, wherein said first locking means includes:

a. a plate on said free end of said third member having a depression therein, and b. a spring-mounted catch extending from said rifle-like unit, and adapted to be received in said depression when said platform means is in its stored position.

15. A support assembly as in claim 12, wherein said second locking element includes:

a. a bracket on said first member on the end remote from said free end and having a socket therein, and b. a ball element extending from said rifle-like unit, and adapted to be received in said socket when said platform is in its operative position.

16. A support assembly as in claim 1, including a storage chamber in said rifle-like unit at said rear end thereof.

17. A support assembly as in claim 16, wherein said storage chamber is adapted to receive a two-way radio therein with a pair of openings extending through said rifle-like unit to coincide with the speaker and receiver on the radio.

18. A support assembly as in claim 1, wherein said rifle-like unit includes:

a. at least one trigger extending from said lower end thereof, and b. at least one barrel chamber extending rearwardly from said free end and adapted to contain an item projectable by engaging of said trigger.

19. A support assembly as in claim 1, including elevational means associated with said holding means so as to permit vertical adjustment of the level of the barrel for adjustment of the sight thereon relative to said sighting means as required.

20. A support assembly as in claim 19, wherein said elevational means includes:

a. a gear rack associated with said holding means, and b. a rotatably mounted gear to mesh with said gear rack for vertical adjustment of said holding means.

* * * * *